United States Patent [19]

Osegowitsch et al.

[11] 4,403,846

[45] Sep. 13, 1983

[54] ARRANGEMENT FOR INTRODUCING PHOTOSENSITIVE STRIPS INTO AND TRANSPORTING THE SAME THROUGH A DEVELOPING MACHINE

[75] Inventors: Viktor Osegowitsch, Taufkirchen; Werner Sperber; Wolfgang Viehrig, both of Munich, all of Fed. Rep. of Germany

[73] Assignee: AGFA-Gevaert AG, Leverkusen, Fed. Rep. of Germany

[21] Appl. No.: 299,771

[22] Filed: Sep. 4, 1981

[30] Foreign Application Priority Data

Sep. 10, 1980 [DE] Fed. Rep. of Germany ..... 3034084

[51] Int. Cl.[3] ..... G03D 13/06

[52] U.S. Cl. ..... 354/310; 354/321; 355/27

[58] Field of Search ..... 354/344, 345, 307, 310, 354/321, 322; 226/92; 355/27

[56] References Cited

U.S. PATENT DOCUMENTS 4,067,034 1/1978 Kwiatkowski ..... 354/307 X 4,218,123 8/1980 Viehrig et al. ..... 354/310

*Primary Examiner*—Richard A. Wintercorn

*Attorney, Agent, or Firm*—Michael J. Striker

[57] ABSTRACT

An arrangement for introducing photosensitive strips into and for transporting the same through the interior of a developing machine includes an attaching compartment at the input part of the machine adjacent to a region into which the leading end of the respective strip is introduced through an input slot, the compartment having two opposite open ends one communicating with the exterior and the other with the interior of the machine. A lid is mounted on the walls bounding the compartment for pivoting between its open and closed positions and is latched in its closed position by a latching device. A separating slide is mounted on rails arranged at the other end for movement across the same between its open and closed positions. The opening of the lid is accomplished by gripping a handgrip which actuates a switch that commences the operation of a drive moving the slide into its closed position. Then, the latching device releases the lid, and the lid is opened. The leading end of the strip is attached to the band and the lid is closed, which triggers opening motion for the separating member.

8 Claims, 2 Drawing Figures

ARRANGEMENT FOR INTRODUCING PHOTOSENSITIVE STRIPS INTO AND TRANSPORTING THE SAME THROUGH A DEVELOPING MACHINE

BACKGROUND OF THE INVENTION

The present invention relates to photographic developing machines in general, and more particularly to arrangements for introducting strips of photosensitive material from cassettes into such machines and for transporting such strips through the interiors thereof.

There are already known photographic developing machines in which the photographic material strips are being treated while passing through the interior of the machine in several paths situated next to one another, wherein the strip-shaped material is advanced through the various treating stations by means of an endless band or belt which travels along the respective path next to the respective strip and to which the leading end of the respective photosensitive strip is to be connected first before being entrained for joint movement with the band. In such machines, the photosensitive strip leading end is usually attached to the band by means of a clamp or clip in an attaching compartment which can be light-tightly separated from the interior of the machine and through which a section of the endless band passes. The attaching compartment can also be light-tightly sealed from the exterior of the machine by a latchable lid. The respective machine then may have an input passage or slot through which the photosensitive strip passes from the interior of the respective cassette which is light-tightly juxtaposed with a zone of the machine into a predetermined region of the interior of the machine which is situated to the attaching compartment, and a pivotable transferring member is provided which is operative for transferring the leading end of the respective strip which has been introduced through the input slot into the aforementioned region of the interior of the machine into the attaching compartment.

One such developing machine is known from the German Pat. No. 25 44 322. In this machine, the transferring member which guides the leading end of the respective photosensitive strip from the interior of the machine into the attaching compartment during the introducing phase of operation of the arrangement simultaneously serves as a separating member light-sealingly separating the attaching compartment from the interior of the machine as long as the lid is open for making the attaching compartment accessible for the performance of the attaching operation therein. However, due to the double function of the transferring member, there have been encountered problems, especially as far as the light-impermeability thereof is concerned. In addition thereto, the functional coupling of the light-sealed closure of the attaching compartment to the exterior and to the interior of the machine leaves much to be desired in the conventional machine of this type, especially since it can happen in some instances that, when the outer lid is opened too rapidly, the inner transferring member has not yet reached its full closed position, so that ambient light will penetrate into the interior of the machine where it may damage other photosensitive strips traveling in their respective paths.

SUMMARY OF THE INVENTION

Accordingly, it is a general object of the present invention to avoid the disadvantages of the prior art.

More particularly, it is an object of the invention to develop an arrangement for introducing photosensitive strips into and transporting the same through the interior of a treating, especially developing, machine, which is not possessed of the disadvantages of the conventional arrangements of this type.

Still another object of the present invention is to so construct the arrangement of the type here under consideration as to provide a reliable light-impermeable separation between the attaching compartment and the interior of the machine even in the event that the operating personnel attempts to follow improper procedures or commits errors.

It is a further object of the invention to so design the arrangement as to be relatively simple in construction, inexpensive to manufacture, easy to operate, and reliable nevertheless.

In pursuance of these objects and others which will become apparent hereafter, one feature of the present invention resides in an arrangement for introducing strips of photosensitive material, particularly such accommodated in cassettes, in a light-sealed manner into and for transporting such strips through the interior of a treating, especially developing, machine having at least one slot for the passage of the respective strip therethrough into a given region of the interior of the machine, which arrangement comprises means for bounding an attaching compartment adjacent to the given region of the interior; means for light-impermeably separating the attaching compartment from the exterior of the machine, including a lid; means for transferring the leading end of the respective strip upon its passage through the slot into the attaching compartment, including a transferring member bounding a light-sealed path for the leading end between the slot and the attaching compartment at least upon the conclusion of the transferring operation; means for transporting the respective strip through the attaching compartment and through the interior of the machine, including an endless band situated next to the respective strip and having a section passing through the attaching compartment, and means for attaching the leading end of the respective strip to the section; and means for light-impermeably separating the attaching compartment from the interior of the machine at least while the lid is open, including a separating member mounted between the attaching compartment and the interior of the machine for movement between an open and a closed position and establishing a light-impermeable contact with the transferring member in its closed position. Advantageously, the arrangement further includes means for causing the separating member to move between its open and closed positions, such causing means preferably including drive means and means for actuating the drive means situated at the exterior of the aforementioned lid.

When the arrangement of the present invention is constructed in the above-discussed manner, there is obtained the advantage that the attaching compartment is separated from the interior of the machine in a sufficiently light-impermeable manner due to the cooperation of the separating member with the transferring member. This effect is especially pronounced when the defining means includes a circumferential wall having a portion of an arcuate cross section adjacent to the slot, when the transferring member has a cross section conforming to that of the arcuate wall portion, and when the separating member has an end portion bounding a recess of a cross section compatible to that of the transferring member and receiving the latter in the closed position. This is attributable to the fact that the arcuate wall portion and the transferring member, on the one hand, and the transferring member and the separating member, on the other hand, bound respective arcuate interfaces between themselves through which no light can pass even if the contact at such interfaces is less than perfect.

Another advantage obtained when the arrangement of the invention is constructed in the above-discussed manner is that a premature opening of the lid is safely prevented, even if the operating personnel attempts to open the lid before the separating member has reached its fully closed position. This is achieved in that, in accordance with another aspect of the present invention, the arrangement is further provided with means for latching the lid in its closing position; and means for releasing the latching means only when the separating member is in its closed position, including means for detecting the closed position of the separating member and for generating a control signal indicative thereof, and means for displacing the latching means into its releasing position in response to the control signal.

A particularly advantageous construction of the arrangement of the present invention is obtained when the transferring member is mounted for movement between a first position next to and a second position remote from the aforementioned path, and when means is provided for moving the transferring member between its positions, including an electromagnet electrically connected with the actuating means. The construction of the arrangement is particularly simple, and its operation especially reliable, when the drive means includes a motor, especially an electric motor, and a crank drive interposed between the motor and the separating member.

According to another facet of the present invention, the arrangement is further equipped with means for discontinuing the advancement of the band through the attaching compartment for the duration of the attaching operation, and when the actuating means includes means for activating the discontinuing means. The discontinuing means advantageously includes an accumulator for the band, and the activating means is operative for activating the accumulator into releasing accumulated sections of the band.

Under certain circumstances it can happen that the leading end of the photosensitive strip is not properly or timely attached to the aforementioned section of the band during the period of time allotted to the attaching operation, especially by the storage capacity of the band accumulator. It is for such conditions that the arrangement is equipped, in accordance with a further facet of the invention, with means for detaching the leading end of the photosensitive strip from the band when the advancement of the latter is recommenced prior to the closing of the lid, such detaching means preferably including a detaching member movable into and out of the trajectory of movement of the strip with the band sections through the attaching compartment, and means for moving the detaching member in dependence on the position of the lid.

While the attaching operation may be performed manually in its entirety, it is advantageous when, in accordance with an advantageous feature of the present invention, a connecting mechanism is arranged in the attaching compartment at the trajectory of movement of the band section, such attaching mechanism being operative for connecting the attaching means to the leading end of the strip and/or to the band section.

The novel features which are considered as characteristic of the invention are set forth in particular in the appended claims. The improved arrangement itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENT

Figure 1:
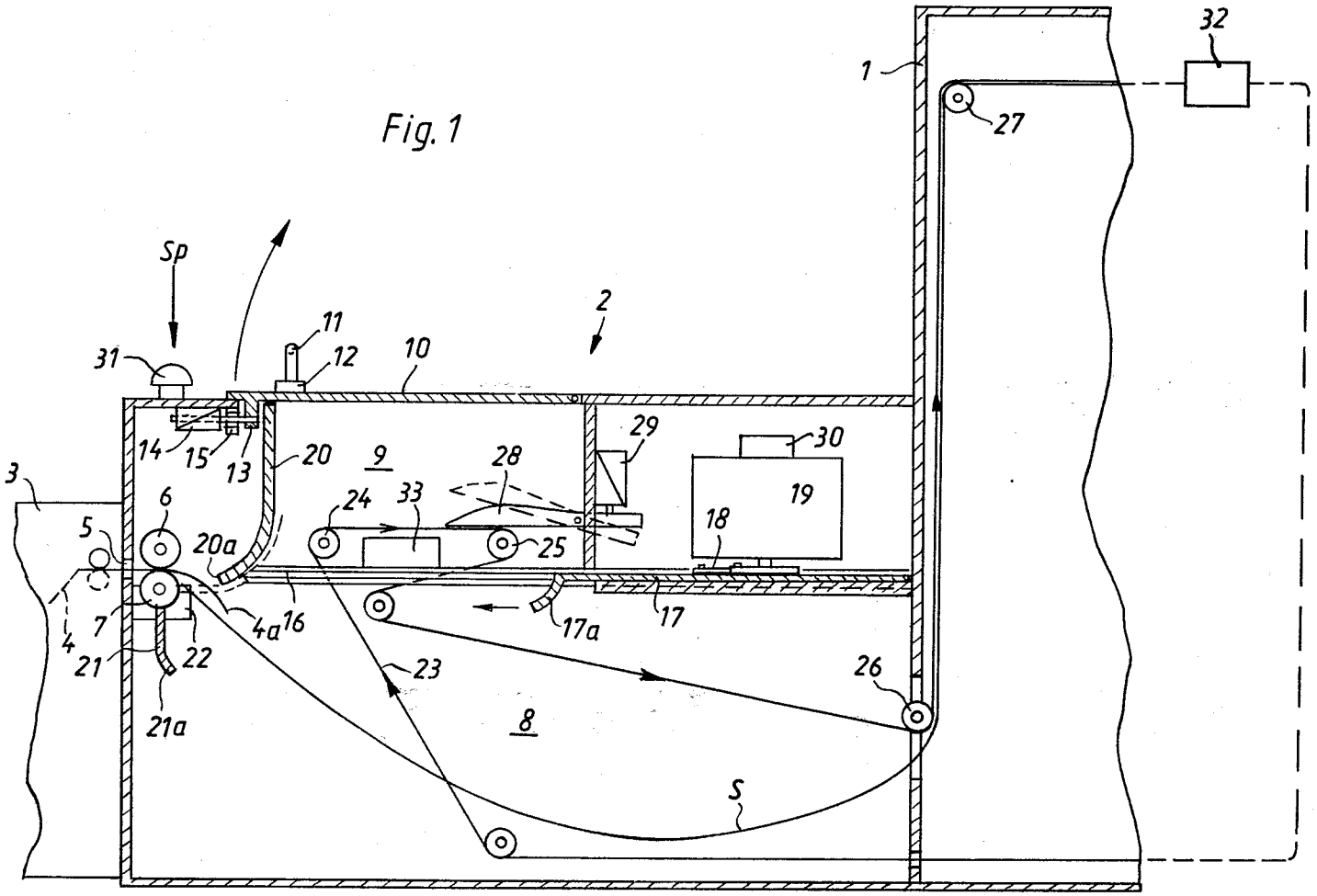
FIG. 1 is a cross sectional view of an input part of a photographic developing machine equipped with an arrangement according to the present invention.

Referring now to the drawing in detail, and first to FIG. 1 thereof, it may be seen that the reference numeral 1 has been used to identify a photographic developing machine in its entirety. The developing machine 1 is of a conventional construction so that no details of the latter which have no bearing on the subject matter of the present invention have been shown. An input part 2 capable of receiving a plurality of cassettes 3 accommodating respective photosensitive strips 4 is arranged upstream of the developing machine 1. One such cassette 3 is illustrated to be juxtaposed with and held on the input part 2, and the leading end of the photosensitive strip 4 is shown to pass through an input channel or slot 5 and between two transport rollers 6 and 7 into a predetermined region of the interior of the input part 2. The leading end of the respective strip 4 is indicated by the reference numeral 4*a* and its is shown to depend into an internal space 8 of the input part 2 of the machine 1 through which a plurality of transporting bands 23, only one of which is shown, passes as well.

An attaching compartment 9 is provided at the upper region of the input part 2, being equipped with a lid 10 that is mounted for movement, especially pivoting movement, from the illustrated closing position thereof to the exterior of the input part 2 into its opening position in which it makes the attaching compartment 9 accessible from the exterior of the input part 2. A movable handgrip is mounted at the exterior of the lid 10, and a switching element 12 is operatively connected thereto to be actuated thereby. A projection 13 extends from the internal surface of the lid 10 into the internal space 8 of the input part 2 as considered in the illustrated closing position of the lid 10. The projection 13 is provided with a recess for receiving a latching pin of an electrically operatable latching device 14. In addition thereto, a sensing device 15 is disposed in the internal space 8 of the input part 2, this sensing device being operative for detecting the proper closing of the lid 10.

Respective rails 16, of which again only one can be seen in FIG. 1, are arranged between the attaching compartment 9 and the internal space 8 at and across the end of the attaching compartment 9 which communicates with the internal space 8. A separating member or slide 17 is guided on the respective rails 16 for movement longitudinally thereof between its retracted or open position and its extended or closed position, in a light-sealed manner. The separating member or slide 17 is caused to move between its open and closed positions by a drive including a motor, especially an electric motor, 19 and a transmission, especially a crank transmission, 18. The transmission 18 is constructed to move the separating slide 17 along its plane which coincides with that of said guide rails 16. The slide 17 has an end portion 17*a* which has a cross-sectional configuration compatible with or conforming to that of an end portion 20*a* of a wall 20 which partially bounds the attaching compartment 9 and is situated upwardly of the input slot 5 of the input part 2.

A transferring member 21 is mounted in the internal space 8 for pivoting about an axis which substantially coincides with that of the lower transporting roller 7 between an inactive position shown in full lines and an active position shown in dash lines. The pivoting movement of the transferring member 21 is caused by an electromagnet 22. The transferring member 21 has a free end portion 21 having a cross sectional shape conforming to that of the arcuate end portion 20*a* of the wall 20 and to the arcuate end portion 17*a* of the separating slide or member 20. When the electromagnet 22 is energized, the transferring member 21 is displaced from its inactive position into its active position in which it abuts the arcuate end portion 17*a* of the wall 17 so that it transfers the leading end 4*a* of the respective photosensitive strip 4 into the attaching compartment, as also shown in broken line in FIG. 1.

The rails 16 are provided, in a well known manner, with light-impermeable passages for a section of the respective transporting band or belt 23. The transporting band 23 is trained about two rollers 24 and 25 between the points of entry of the respective band section into the compartment 9 and of exit therefrom through the respective sealed passages, so that the section of the band 23 which is momentarily present in the attaching compartment has a substantially horizontal stretch intermediate the rollers 24 and 25. After entering the internal space 8, the band 23 is trained about a deflecting roller 26 and a first transporting roller 27 of the developing machine 1 proper.

A detaching member 28 of a conventional construction and function is arranged at the end of the horizontal stretch of the transporting band 23 in the attaching compartment 9. The detaching member 28 is mounted for pivoting between its rest position shown in solid lines in which it contacts the horizontal stretch of the band 23, and its retracted position shown in dashed lines. A lifting electromagnet 29 acts on an end of the detaching member 28 and is operative for pivoting the latter, when energized, from the rest position into the retracted position.

A control arrangement 30 is arranged at the motor 19 associated with the separating slide 17, and it is operative for generating at least one control signal indicative of the assumption of the closed position by the separating slide 17. Furthermore, a switch 31 is arranged at the exterior of the input part 2. The function of the switch 31 is to cause a temporary discontinuance of the advancement of the band 23 through the attaching compartment 9 for a predetermined period of time which is deemed to be sufficient for performing the attaching operation proper and the operations preceding and succeeding the same. Advantageously, the switch activates a band accumulator 32, which is of a conventional construction and hence has been illustrated only as a box, so that the accumulator 32 gradually releases a section of the band 23 previously stored therein. In this manner, it is not necessary to stop the respective band 23 in its entirety each time another strip end portion 4*a* is to be attached. The storage capacity of the accumulator is correlated to the speed of advancement of the band 23 through the machine 1 such that the aforementioned sufficient period of time becomes available under all circumstances.

Figure 2:
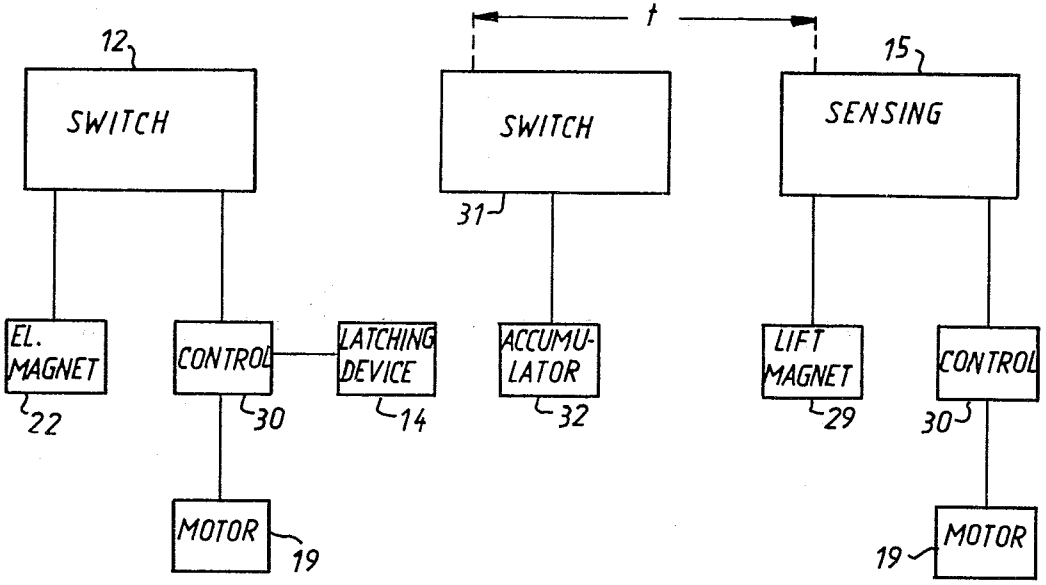
FIG. 2 is a flow chart representative of the various control operations performed in use of the arrangement of FIG. 1.

Having so discussed the construction of the developing machine and of the input part thereof, the operation of the arrangement according to the present invention will now be explained with particular reference to the flow diagram shown in FIG. 2, as well as to the illustration depicted in FIG. 1.

After the respective cassette 3 has been juxtaposed with and/or mounted on the input part 2 and after a sufficient length of the photosensitive strip 4 has been introduced through the slot 5 between and past the transporting rollers 6 and 7, which may be spaced apart during the introduction of the leading end 4*a* of the strip 4 therebetween, as usual, the operator of the machine 1 grips the handgrip 11 and thus actuates the switch 12; however, the operator is not yet able to open the lid 10. Rather, the switch 12 first activates the electromagnet 22 as well as, via the control arrangement 30, the motor 19. The electromagnet 22 pivots the transferring member 21 in the counterclockwise direction, so that the leading end 4*a* of the photosensitive strip 4 is entrained for joint movement therewith and is thus transferred into the attaching compartment 9. At the end of its pivoting movement, the transferring member 21 confines the leading end 4*a* between itself and the arcuate end portion 20*a* of the wall 20 while the leading end extends to a certain distance beyond the confinement region. In the meantime, the motor 19 and the transmission 18 move the separating slide 17 in its closing direction, until the arcuate end portion 17*a* of the slide 17 comes to rest against and partially receives the arcuate end portion 21*a* of the transferring member 21. In this manner, there is obtained a light-impermeable separation of the attaching compartment 9 from the internal space 8 of the input part 2 of the machine 1.

The control arrangement 30 detects the reaching of the fully closed position by the separating slide 17 by monitoring the angular displacement of the output shaft of the motor 19 and issues a control signal which is transmitted to the latching device 14 and causes the same to release the projection 13 of the lid 10. Thus, it is only now, that is, after the separating member 17 has been fully closed, that the operator is able to open the lid 10. After opening the lid 10, the operator has as much time available as necessary for connecting the leading end 4*a* of the photosensitive strip 4 to a clip or a similar attaching member. As soon as this is achieved, the operator depresses the switch 31, which results in the discontinuation of advancement of the band 23 through the attaching compartment 9, while the band accumulator 32 is activated. At this time, the operator is able to connect the clip or similar attaching member to the section of the band 23 which is then present in the attaching compartment 9, especially to the horizontal stretch thereof extending between the rollers 24 and 25.

This can be accomplished either fully manually, or by resorting to the use of a connecting mechanism of a conventional construction as disclosed, for instance, in the published German application DE-OS 25 12 826. As mentioned above, the period of time for which the advancement of the band 23 through the attaching compartment 9 is discontinued depends on the speed of advancement of the band 23 prior to the discontinuation, and on the storage capacity of the accumulator 32, and it can amount, for instance, to 4 to 7 seconds. The attaching or connecting operation proper takes about 1 to 2 seconds. The remainder of the time period is more than sufficient for closing the lid 10. As soon as the lid 10 reaches its closing position, the latching device 14 becomes effective again, so that the lid 10 cannot be immediately reopened.

At the time of latching of the lid 10, another control signal is issued either by the latching device 14, or by the sensing device 15, this control signal causing the energization of the lifting electromagnet 29. In this manner, the detaching member 28 is lifted off from the transporting band 23 so that, after the advancement of the band 23 is recommenced at the termination of the active period of the accumulator 32, it will not interfere with the joint movement of the band with the leading end 4*a* of the strip 4 attached thereto. The sensing device 15 also issues a command signals, which may be identical to the other control signal, which is transmitted to the control arrangement 30 which restarts the operation of the motor 19 which is continued until the separating member 17 has reached its open position. As mentioned above, the band 23 entrains the leading end 4*a* and causes the latter to move in a trajectory which eventually leads around the rollers 26 and 27. Inasmuch as no guiding roller is provided for the strip 4 in the attaching compartment 9, the strip is merely guided in the internal space 8. As a result of a proper control of the rotational speed of the transporting rollers 6 and 7 with respect to the machine advancement speed, it can be achieved that the strip 4 forms a loop S in the internal space 8.

Should the operator be unable to perform te attaching operation within the time limit available therefor, that is, the time period during which the advancement of the section of the band 23 which is present in the attaching compartment 9 is discontinued, be it that the attaching as such takes too long or that the lid 10 could not have been closed in time, the sensing device 15 does not issue any signal, so that the lifting electromagnet 29 is not energized. Nevertheless, the band section recommences its advancement at the termination of this period of time and, consequently, the detaching member 28 which has remained in its rest position in which it contacts the band 23 removes the clip connecting the leading end to the transporting band 23 from the latter. In this manner, damages which have been previously encountered either on the equipment or on the transporting band 23 when the separating slide could not be opened in time are avoided.

In the simplest case, the control arrangement 30 for the motor 19 can include two microswitches which sense the arrival of the separating slide 17 at the respective open and closed positions thereof and which interrupt the supply of electric current to the motor 19 when actuated. In this case, the signals derived from the switch 12 and from the sensing device would have to be capable of restoring the supply of electric current to the motor 19 for energizing the same.

The electromagnet 22 and the lifting electromagnet 29 for incorporate respective time-delay members which are operative for discontinuing the supply of electric current after a predetermined period of time has elapsed from the issuance of the respective control signal. Thus, for instance, the electromagnet 22 may already be de-energized when the separating slide 17 commences its movement toward the open position, so that the gravity force pivots the transferring member 21 into its position shown in solid lines. In a similar manner, even the lifting electromagnet 29 is de-energized after the expiration of a certain period of time, namely, after the band 23 has carried the clamp or similar attaching member connecting the leading end 4*a* of the respective strip 4 to the band 23 past the detaching zone in the attaching compartment 9.

Of course, the control of the operation of the detaching member 28 could also be accomplished in the reversed manner, that is, the attaching member 28 could assume its lifted position when the lifting electromagnet 29 is de-energized and its active position upon energization of the lifting electromagnet 29, which occurs when the signal from the sensing device 15 is still outstanding at the time at which the band 23 recommences its advancement.

It is to be understood that each of the elements described above, or two or more together, may also find a useful application in other types of arrangements differing from the type described above.

While the invention has been illustrated and described as embodied in an arrangement for introducing strips of photosensitive material from cassettes into and for transporting such strips through the interior of a photographic developing machine, it is not intended to be limited to the details shown, since various modifications and structural changes may be made without departing in any way from the spirit of the present invention.

Without further analysis, the foregoing will so fully reveal that gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. An arrangement for introducing strips of photosensitive material, particularly such accommodated in cassettes, in a light-sealed manner into and for transporting such strips through the interior of a treating, especially developing, machine having at least one slot for the passage of the respective strip therethrough into a given region of the interior, comprising means for bounding an attaching compartment adjacent to the given region of the interior; means for light-impermeably separating said attaching compartment from the exterior of the machine, including a lid; means for transferring the leading end of the respective strip upon its passage through the slot into said attaching compartment, including a pivotable transferring member bounding a light-sealed path for the leading end between the slot and said attaching compartment at least upon the conclusion of the transferring operation; means for transporting the respective strip through said attaching compartment and through the interior of the machine, including an endless band situated next to the respective strip and having a section passing through said attaching compartment, and means for attaching the leading end of the respective strip to said section; means for light-impermeably separating said attaching compartment from the interior of the machine while said lid is open, including a separating member mounted between said attaching compartment and the interior of the machine for movement between an open and a closed position and establishing a light-impermeable contact with said transferring member in said closed position; means for causing said separating member to move between said positions thereof, including drive means; means for latching said lid in its closing position; and means for releasing said latching means when said separating member is in the closed position thereof, including control means connected to said drive means and operative for detecting the closed position of said separating member and for generating a control signal indicative thereof; and means for displacing said latching means into its releasing position in response to said control signal.

2. The arrangement as defined in claim 1, wherein said defining means includes a circumferential wall having a portion of an arcuate cross section adjacent to the slot; wherein said transferring member has a cross section conforming to that of said wall portion; and wherein said separating member has an end portion bounding a recess of a cross section compatible to that of said transferring member and receiving the latter in said closed position.

3. The arrangement as defined in claim 1, wherein said transferring member is mounted for movement between a first position next to and a second position remote from said path; and further comprising means for moving said transferring member between said positions thereof, including an electromagnet electrically connected with said actuating means.

4. The arrangement as defined in claim 1, wherein said drive means includes a motor, and a crank drive interposed between said motor and said separating member.

5. The arrangement as defined in claim 1, further comprising means for discontinuing the advancement of said band through said attaching compartment for the duration of the attaching operation; and wherein said actuating means includes means for activating said discontinuing means.

6. The arrangement as defined in claim 5, wherein said discontinuing means includes an accumulator for said band; and wherein said activating means is operative for activating said accumulator into releasing accumulated sections of said band.

7. The arrangement as defined in claim 5, and further comprising means for detaching the leading end from said band when the advancement of the band is recommenced prior to the closing of said lid, including a detaching member movable into and out of the trajectory of movement of the strip with said band section through said attaching compartment, and means for moving the detaching member in dependence on the position of said lid.

8. The arrangement as defined in claim 1; and further comprising a connecting mechanism in said attaching compartment at the trajectory of movement of said band section for connecting said attaching means to the leading end of the strip and to said band section.

* * * * *